US006116439A

United States Patent [19]

Yaniv

[11] Patent Number: 6,116,439

[45] Date of Patent: Sep. 12, 2000

[54] BABY BOTTLE AND MILK STORAGE ASSEMBLY

[75] Inventor: Wendy Solomon Yaniv, Marietta, Ga.

[73] Assignee: Babe Eez, L.L.C., Marietta, Ga.

[21] Appl. No.: 09/292,176

[22] Filed: Apr. 15, 1999

[51] Int. Cl.[7] ..... A61J 9/00; B65D 1/04; B65D 21/036

[52] U.S. Cl. ..... 215/11.1; 215/6; 215/10; 220/4.26

[58] Field of Search ..... 215/6, 11.1, 10; 220/4.26

[56] References Cited

U.S. PATENT DOCUMENTS

| | | | |
|---|---|---|---|
| 779,749 | 1/1905 | Tinling | 215/11.1 |
| 1,070,516 | 8/1913 | O'Brien | 215/11.1 X |
| 1,434,460 | 11/1922 | Tibbatts | 215/11.1 X |
| 1,466,311 | 8/1923 | Mobley | 215/11.1 |
| 1,622,512 | 3/1927 | Holladay | 215/11.1 |
| 2,326,414 | 8/1943 | Thompson | 215/6 X |
| 2,766,796 | 10/1956 | Tupper | 215/6 X |
| 2,833,436 | 5/1958 | Ruderian | 215/6 |
| 2,843,281 | 7/1958 | Gallois | 215/6 X |
| 2,887,239 | 5/1959 | Reed et al. | 215/11.1 |
| 3,134,494 | 5/1964 | Quinn | 215/11.3 |
| 3,143,205 | 8/1964 | Ruderian | 215/6 X |
| 3,552,548 | 1/1971 | Wallestad et al. | 215/6 X |
| 3,650,270 | 3/1972 | Frazier | 215/11.1 X |
| 4,778,068 | 10/1988 | Kohus | 215/11.1 |
| 4,813,556 | 3/1989 | Lawrence | 215/11.3 |
| 5,588,548 | 12/1996 | Brankley | 215/11.1 X |
| 5,638,968 | 6/1997 | Baron et al. | 215/11.4 |
| 5,758,787 | 6/1998 | Sheu | 215/11.3 |

*Primary Examiner*—Sue A. Weaver
*Attorney, Agent, or Firm*—Pitts & Brittian, P.C.

[57] ABSTRACT

A baby bottle and milk storage assembly configured to define a segmented configuration, with each segment being useful for storing and dispensing a food product used for feeding an infant. The bottle assembly is configured such that a plurality of bottle segments may be joined in fluid communication in an end-to-end fashion. For storage, individual or joined segments may be easily stacked in a nesting relationship. The bottle assembly includes at least one bottle segment, at least one end cap, at least one connector ring, and a neck member. An end cap is secured to the bottom end of a bottle segment and serves to close the bottom end of the bottle segment and as a base for the bottle assembly. Either an end cap or a connector ring is mounted on the upper end of the bottle segment. In the event a connector ring is mounted on the upper end of the bottle segment, another bottle segment or a neck member is mounted thereon. The end cap defines an end wall about which is disposed an annular wall which defines an upper end extending above the end wall and a lower end extending below the end wall. The lower end of the annular wall defines an enlarged radius to accomplish nesting of two such end caps.

13 Claims, 3 Drawing Sheets

BABY BOTTLE AND MILK STORAGE ASSEMBLY

DESCRIPTION

1. Technical Field

This invention relates to the field of baby feeding devices. More specifically, the present invention relates to a device for feeding an infant and for storing food products such as breast milk.

2. Background Art

It is well known that there are many conventional bottle-type devices for feeding an infant. These devices have different configurations for receiving a liquid, or highly fluid, food product. Most such devices are provided with a fixed capacity, but with gradient indicators for assisting with filling the bottle and with monitoring the consumption of the infant. Others are provided with a flexible liner for receiving the consumable, the liner conforming to the consumable in order to prevent the intake of air. There are also various bottles which are provided with a means for varying the interior volume, either gradually or in increments.

Typical of the art are those devices disclosed in the following U.S. Patents:

| U.S. Pat. No. | Inventor(s) | Issue Date |
|---|---|---|
| 3,134,494 | P. N. Quinn | May 26, 1964 |
| 4,778,068 | L. M. Kohus | Oct. 18, 1988 |
| 4,813,556 | G. D. Lawrence | Mar 21, 1989 |
| 5,588,548 | J. R. Brankley | Dec. 31, 1996 |
| 5,638,968 | M. S. Baron, et al. | June 17, 1997 |
| 5,758,787 | M. S. Sheu | June 2, 1998 |

Of these patents, U.S. Pat. No. 3,134,494 issued to Quinn teaches an infant feeding device designed to prevent the introduction of air into the interior volume defined thereby as the contents are withdrawn. In one embodiment of the '494 device, each end defines a threaded neck for engaging a female threaded cap or nipple retainer. However, in each embodiment, Quinn discloses a flexible liner disposed in the bottom opening, the liner preventing escape of fluid from the bottle and the entrance of air into the bottle. Further, Quinn does not teach a devices for mounting multiple segments together for fluid communication therebetween. On the contrary, the use of the flexible liner at the bottom end teaches away from such construction.

Kohus, in U.S. Pat. No. 4,778,068, discloses a segmented baby feeding bottle comprised of a lower part and an upper part. A collar is mountable on either of the lower and upper parts. The upper part defines a receptor for mounting on the lower part. To this extent, the upper part may only be used when attached to the lower part. Specifically, the upper part alone may not be used for either storage or dispensation of baby food, milk or the like.

U.S. Pat. No. 4,813,556, issued to G. D. Lawrence, discloses another embodiment of a collapsible baby bottle. The volume within the '556 device is adjustable by means of a portion of the side wall defining a plurality of bellows that may be extended to define a maximum volume or collapsed to define a minimum volume. Lawrence does not teach a bottle having a variable volume by means of a segmented wall. Moreover, Lawrence does not teach a bottle which may be easily stacked on another such bottle for storage purposes.

Brankley, in U.S. Pat. No. 5,588,548, discloses a baby bottle neck attachable between a baby bottle and a nipple.

The baby bottle neck of the '548 device is similar to the bellow portion of the '556 device described above. This configuration allows for the adjustability of the orientation of the nipple with respect to the bottle in order to minimize the volume of air a feeding infant intakes, and allows for a greater volume within the bottle to be consumed. Brankley does not disclose a device for the storage of baby food, milk or the like.

U.S. Pat. No. 5,638,968, issued to M. S. Baron, et al., discloses a baby bottle extension assembly configured to be disposed between a baby bottle and a nipple end cap. The extension assembly is comprised of a lower attaching structure which is releasably mounted to the baby bottle and an internal chamber slidably received within the lower attaching assembly and on which the nipple end cap is mounted. The internal chamber is provided for storing baby formula, with the baby bottle filled with water, until feeding time, at which point the baby formula and water are mixed. Baron, et al., do not teach, however, a segmented baby bottle, wherein each segment may be used for storage or feeding, and which may be secured to another such bottle segment in an end-to-end fashion to achieve a bottle of a selected volume.

Sheu, in U.S. Pat. No. 5,758,787, discloses a nursing assembly which is removably securable to a disposal cup. The '787 device is especially useful for the care giver of an infant while traveling, or in other situations where cleaning a non-disposable container is impractical. Sheu does not disclose a segmented baby bottle. Nor does Sheu disclose a device which is useful for long-term storage of a feeding product.

Although the prior art is replete with various types of baby feeding devices, devised with many different purposes in mind, the prior art does not disclose a baby bottle having a segmented configuration, with each segment being useful for feeding a child, or for storage of a food product. Moreover, the prior art discussed does not disclose a bottle segment which may be joined in fluid communication in an end-to-end fashion with another such bottle segment. Nor does this prior art disclose a device for joining such bottle segments one to another, or for closing an end of such a bottle segment.

Therefore, it is an object of this invention to provide a baby bottle having a segmented configuration, with each segment being useful for feeding a child, or for storage of a food product.

Another object of the present invention is to provide such a segmented baby bottle whereby each segment portion is configured to be joined in fluid communication in an end-to-end fashion with another such bottle segment.

Yet another object of the present invention is to provide such a segmented baby bottle which is provided for a device for joining such bottle segments one to another, and a device for closing an end of such a bottle segment.

DISCLOSURE OF THE INVENTION

Other objects and advantages will be accomplished by the present invention which is configured to define a segmented configuration, with each segment being useful for storing and dispensing a food product used for feeding an infant. The bottle assembly is further configured such that a plurality of segments may be joined in fluid communication in an end-to-end fashion with another such bottle segment. For storage, individual or joined segments may be easily stacked in a nesting relationship.

The bottle assembly of the present invention is primarily comprised of at least one bottle segment, at least one end cap, at least one connector ring, and a neck member. An end cap is secured to the bottom end of the bottle segment and serves not only to close the bottom end of the bottle segment, but also as a base for the bottle assembly. Either an end cap or a connector ring is mounted on the upper end of the bottle segment. In the event a connector ring is mounted on the upper end of the bottle segment, another bottle segment or a neck member is mounted thereon. Any number of bottle segments may be connected in fluid communication in this manner, with either an end cap closing the top of the bottle assembly or a neck member and a nipple and nipple connector ring allowing dispensation of the contents.

The end cap defines an end wall about which is disposed an annular wall which defines an upper end extending above the end wall and a lower end extending below the end wall. Each of the upper end and the lower end of the annular wall defines a female threaded portion for cooperating with a male threaded portion of a bottle segment. The lower end of the annular wall defines an enlarged radius to accomplish nesting of two such end caps. Specifically, the internal diameter of the enlarged radius portion of the annular wall lower end is dimensioned to closely receive the annular wall upper end of another end cap. A sealing ring is formed on each side of the end cap end wall to form a seal preventing fluid communication between the bottle segment and the end cap.

The connector ring is defined by an annular wall defining a female threaded portion at each end thereof A centrally disposed limiting member is provided for limiting the engagement between the connector ring and each bottle segment or neck member connected thereto.

Each bottle segment is defined by an annular side wall having a male threaded portion defined at each end thereof Each male threaded portion is configured to engage either female threaded portion of the end cap or either female threaded portion defined by the connector ring. The diameter and height of the bottle segment is selected to define an interior volume.

The neck member is provided for establishing fluid communication between the bottle segment(s) and a conventional nipple. To this extent, the lower end of the neck member defines a first male threaded portion dimensioned to engage a female threaded portion of the connection ring. The upper end of the neck member defines a second male threaded portion configured to engage the female threaded portion of a conventional nipple connector ring.

BRIEF DESCRIPTION OF THE DRAWINGS

The above mentioned features of the invention will become more clearly understood from the following detailed description of the invention read together with the drawings in which.

BEST MODE FOR CARRYING OUT IN INVENTION

A baby bottle and milk storage assembly incorporating various features of the present invention is illustrated generally at 10 in the figures. The baby bottle and milk storage assembly, or bottle assembly 10, is configured to define a segmented configuration, with each bottle segment 12 being useful for storing and dispensing a food product used for feeding an infant. The bottle assembly 10 is further configured such that a plurality of bottle segments 12 may be joined in fluid communication in an end-to-end fashion with another such bottle segment 12. For storage, individual or joined bottle segments 12 may be easily stacked in a nesting relationship.

Figure 1:
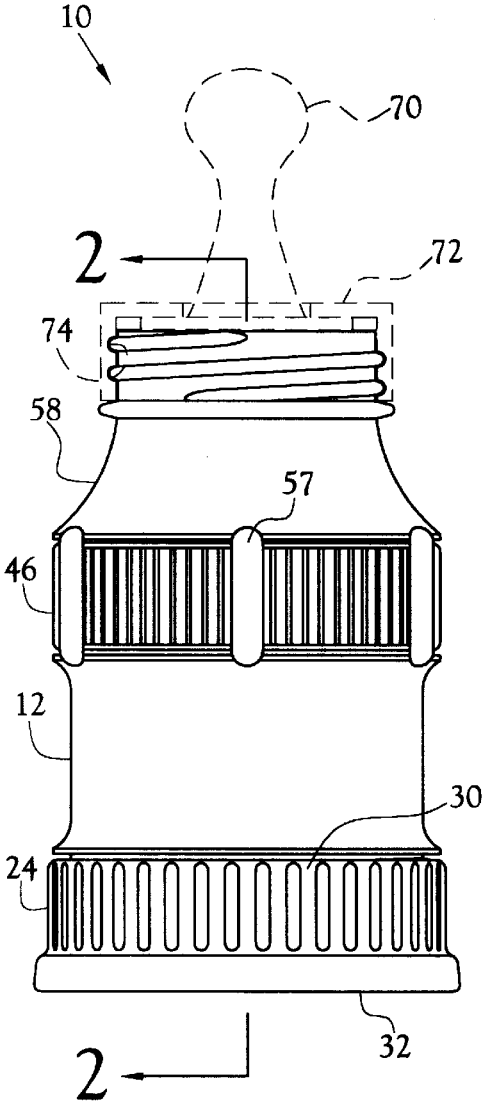
FIG. 1 is a front elevation view of the baby bottle and milk storage assembly constructed in accordance with several features of the present invention utilizing a single bottle segment, shown in use with a neck member and a nipple.

The bottle assembly 10 of the present invention is primarily comprised of at least one bottle segment 12, at least one end cap 24, at least one connector ring 46, and a neck member 58. These various components are illustrated in FIG. 1, which is a front elevation view of the bottle assembly 10. An end cap 24 is secured to the bottom end 16 of the bottle segment 12. The end cap 24 thus serves not only to close the bottom end 16 of the bottle segment 12, but also as a base for the bottle assembly 10. A connector ring 46 is mounted on the upper end 18 of the bottle segment 12. The neck member 58 is connected to the connector ring 46. At the upper end 66 of the neck member 58, a nipple 70 and nipple connector ring 72 are illustrated. The nipple 70 and nipple connector ring 72 are of a conventional configuration, and are therefore illustrated in phantom.

Figure 2:
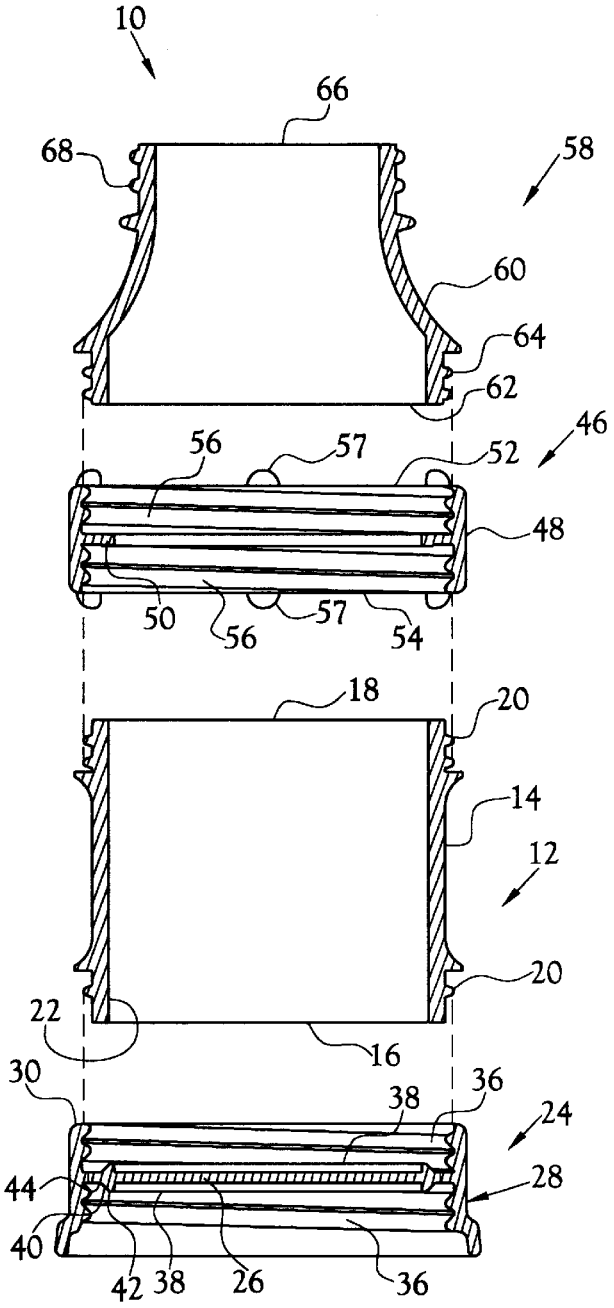
FIG. 2 is an exploded side elevation, in section, of the baby bottle and milk storage assembly taken at 2—2 of FIG. 1.
Figure 5:
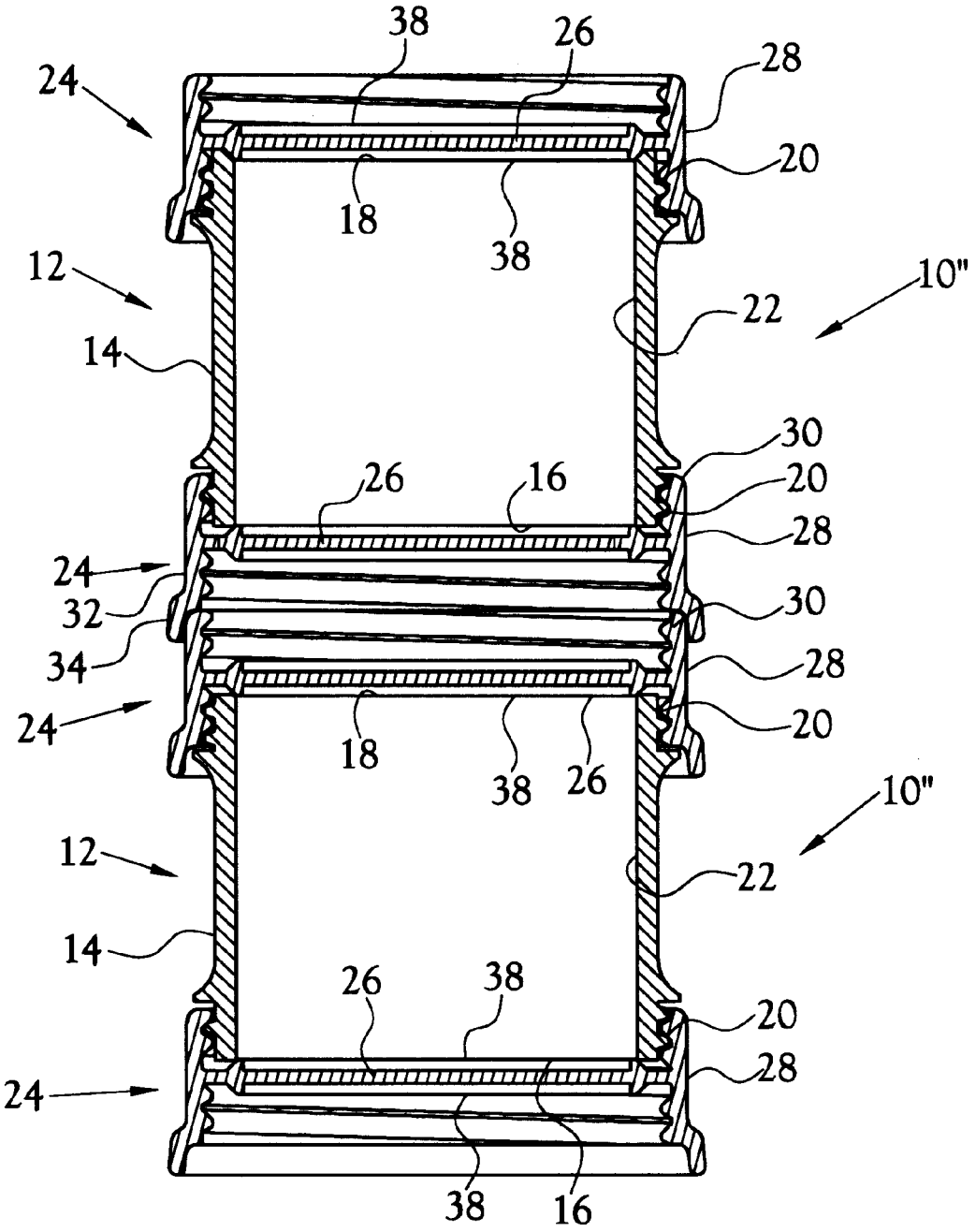
FIG. 5 is a side elevation view, shown partially in section, of two single bottle segments shown with an end cap mounted on each end of each bottle segments, and the bottle segments stacked one on top of the other for storage of a food product.

FIG. 2 more clearly illustrates the individual components of the bottle assembly 10 of the present invention. In this figure, the various components are shown in an exploded, cross-sectional view. The end cap 24 defines an end wall 26 about which is disposed an annular wall 28. The annular wall 28 defines an upper end 30 extending above the end wall 26 and a lower end 32 extending below the end wall 26. Each of the upper end 30 and the lower end 32 of the annular wall 28 defines a female threaded portion 36 for cooperating with a male threaded portion 20 of a bottle segment 12 as described below. The lower end 16 of the annular wall 14 defines an enlarged radius portion 34 to accomplish nesting of two such end caps 24. Specifically, as best illustrated in FIG. 5, the internal diameter of the enlarged radius portion 34 of the annular wall lower end 32 is dimensioned to closely receive the annular wall upper end 30 of another end cap 24. To assist in nesting and un-nesting such end caps 24, in the illustrated embodiment, the enlarged radius portion 34 defines a slight outward taper.

A sealing ring 38 is formed on each side of the end cap end wall 26. The sealing ring 38 is concentric with the end wall 26 and defines a raised portion for engaging the interior radius 22 of the bottle segment 12. To accomplish a greater seal, the sealing ring 38 defines a sloped outer wall 40 having an upper radius 42 smaller than the internal radius 22 of the bottle segment 12, and a lower radius 44 greater than the internal radius 22 of the bottle segment 12. Thus, when a bottle segment 12 is engaged within an end cap 24, the interior of the bottle segment 12 engages the sloped outer wall 40 of the sealing ring 38. As the end cap 24 and bottle segment 12 are tightened in relation to each other, a seal preventing fluid communication between the two components is formed.

Each bottle segment 12 is defined by an annular side wall 14 having a male threaded portion 20 defined at each end 16, 18 thereof. Each male threaded portion 20 is configured to engage either female threaded portion 36 of the end cap 24. As will be described below, each male threaded portion 20 is further configured to engage either female threaded portion 56 defined by the connector ring 46. The diameter and height of the bottle segment 12 is selected to define an interior volume. For sake of uniformity, each bottle segment 12 of the present invention defines the same diameter, while bottle segments 12 of various lengths may be selected in order to better customize the volume within the bottle assembly 10. In the illustrated embodiment, however, each bottle segment 12 is of identical length and, therefore, volume.

The connector ring 46 is provided for connecting two bottle segments 12 or a bottle segment 12 and a neck member 58 in fluid communication. The connector ring 46 is defined by an annular wall 48 defining a female threaded portion 56 at each end 52, 54 thereof Each end 52, 54 of the connector ring 46 is substantially identical to the other such that the orientation of the connector ring 46 is not critical. A centrally disposed limiting member 50 is provided for limiting the engagement between the connector ring 46 and each bottle segment 12 or neck member 58 connected thereto. In the illustrated embodiment, a plurality of raised tabs 57 are disposed radially about the exterior of the connector ring 46 to assist in tightening the connector ring 46 to the bottle segment 12 or neck member 58.

The neck member 58 is provided for establishing fluid communication between the bottle segment(s) 12 and a conventional nipple 70. To this extent, the lower end 62 of the neck member 58 defines a first male threaded portion 64 dimensioned to engage a female threaded portion 56 of the connector ring 46. The upper end 66 of the neck member 58 defines a second male threaded portion 68 configured to engage the female threaded portion 74 of a conventional nipple connector ring 72. The side wall 60 of the neck member 58 defines a taper between the lower and upper ends 62, 66. In the illustrated embodiment, the taper defines an arcuate configuration. However, it will be understood that other configurations may be used with similar success.

Figure 3:
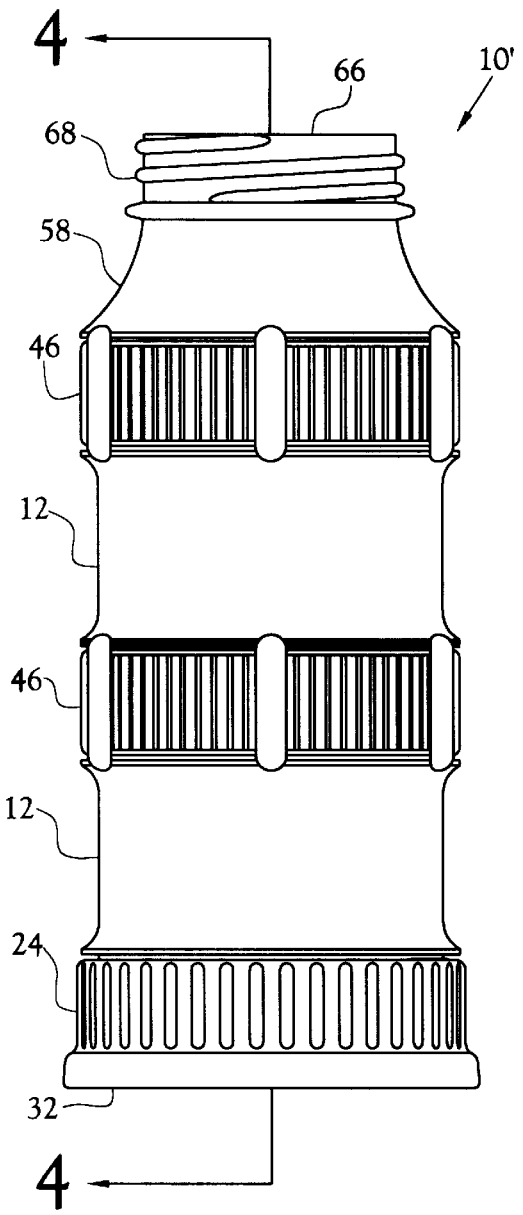
FIG. 3 is a front elevation view of the baby bottle and milk storage assembly constructed in accordance with several features of the present invention utilizing two bottle segments joined in end-to-end fashion.

FIG. 3 illustrates the use of two bottle segments 12 in series to accomplish a bottle assembly 10' having an enlarged volume. The two bottle segments 12 are joined in fluid communication via a connector ring 46. An end cap 24 is mounted on the lower end 16 of one bottle segment 12 to define the lower end wall of the bottle assembly 10'. A neck member 58 is mounted on the upper end 18 of the other bottle segment 12 via a connector ring 46. As will be understood, any selected number of bottle segments 12 may be secured in fluid communication in similar fashion to accomplish bottle assemblies 10 of varying volumes. Although not illustrated, the conventional nipple 70 and nipple connector ring 72 are mounted on the upper end 66 of the neck member 58 for dispensing the contents of the bottle assembly 10'.

Figure 4:
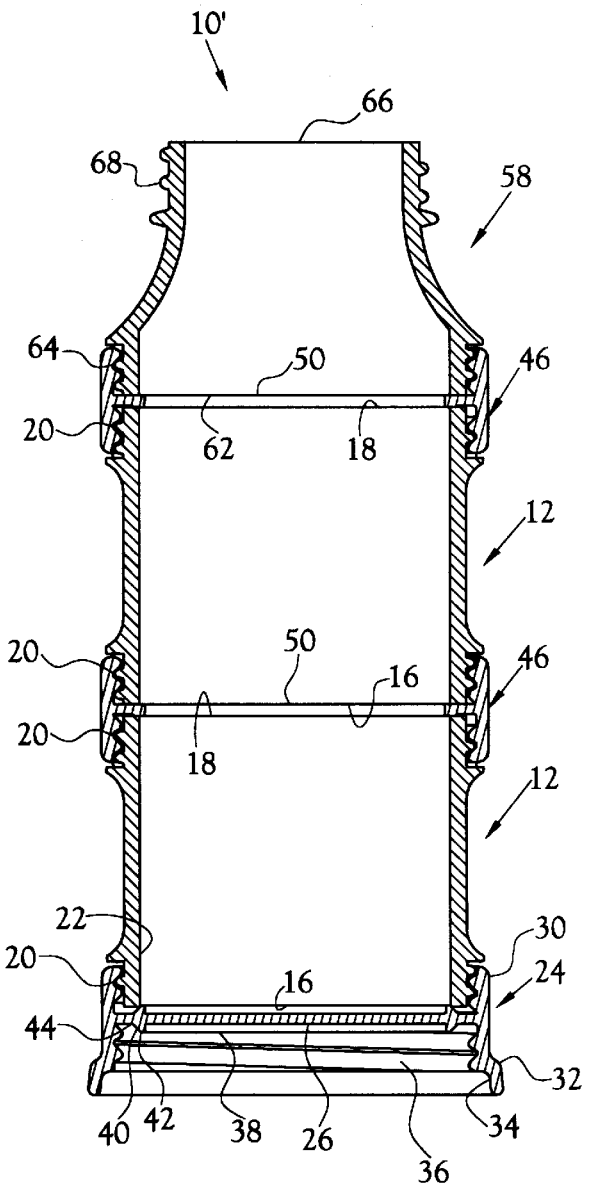
FIG. 4 is aide elevation, in section, of the baby bottle and milk storage assembly taken at 4—4 of FIG. 3.

Illustrated in FIG. 4 is a cross-section of the bottle assembly 10' illustrated in FIG. 3. This figure illustrates each of the bottle segments 12, the end cap 24 and the connector rings 46 in cross-section to more clearly show the fluid communication between the individual bottle segments 12 and the upper bottle segment 12 and the neck member 58.

In FIG. 5, two bottle segments 12 are illustrated in a stacked and nested relation. Each bottle segment 12 is provided with an end cap 24 mounted on each end 16, 18 thereof. The enlarged radius portion 34 of the end cap 24 mounted on the lower end 16 of the upper of the two bottle segments 12 receives the upper end 30 of the end cap 24 mounted on the upper end 18 of the lower bottle segment 12. Thus, nesting is accomplished to prevent the upper bottle segment 12 from moving laterally with respect to the lower bottle segment 12. This feature allows for efficient long-term storage of a food product within the illustrated bottle assemblies 10".

Although the various components of the bottle assembly 10 of the present invention are disclosed as being secured one to another using cooperating threaded portions, it is not intended that the present invention be limited to such securement mechanism. Moreover, it will be understood that any conventional securement mechanism - whether presently known or devised in the future - may be used to secure the various components of the present invention in a sealed fashion one to the other.

From the foregoing description, it will be recognized by those skilled in the art that a baby bottle and milk storage assembly offering advantages over the prior art has been provided. Specifically, the bottle assembly defines a segmented configuration, with each segment being useful for storing and dispensing a food product used for feeding an infant. The individual bottle segments of the bottle assembly may be joined in fluid communication in an end-to-end fashion with another such bottle segment. Further, when used for storage, individual or joined bottle segments may be easily stacked in a nesting relationship.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A baby bottle and milk storage assembly comprising:

at least one bottle segment defined by an annular side wall, said annular side wall defining a lower end and an upper end and an interior radius;

at least one end cap defining an end wall and an annular wall, said annular wall being disposed about said end wall and defining an upper end extending above said end wall and a lower end extending below said end wall, said lower end of said annular wall defining an internal diameter dimensioned to closely receive said annular wall upper end of another said at least one end cap, said at least one end cap defining a sealing ring on an upper side and a lower side of said end wall, said sealing ring being concentric with said end wall and defining a raised portion for engaging an interior radius of said at least one bottle segment, said sealing ring raised portion defining a sloped outer wall having an upper radius smaller than said interior radius of said at least one bottle segment, and a lower radius greater than said interior radius of said at least one bottle segment;

a first securement mechanism for releasably securing said annular side wall lower end to said at least one end cap upper end; and a second securement mechanism for releasably securing said annular side wall upper end to said at east one end cap lower end.

2. The baby bottle and milk storage assembly of claim 1 wherein said first securement mechanism includes a male threaded portion defined by said lower end of said at least one bottle segment annular side wall and a cooperating female threaded portion defined by said upper end of said at least one end cap annular wall, and wherein said second securement mechanism includes a male threaded portion defined by said upper end of said at least one bottle segment annular side wall and a cooperating female threaded portion defined by said lower end of said at least one end cap annular wall.

3. The baby bottle and milk storage assembly of claim 1 further comprising:

at least one connector ring for connecting one said at least one bottle segment in fluid communication with at least another said at least one bottle segment, said connector ring being defined by an annular wall having an upper end and a lower end;

a third securement mechanism for releasably securing said at least one connector ring side wall lower end to said at least one bottle segment annular side wall upper end; and a fourth securement mechanism for releasably securing said at least one connector ring side wall upper end to at least said at least one bottle segment annular side wall lower end.

4. The baby bottle and milk storage assembly of claim 3 wherein said third securement mechanism includes a male threaded portion defined by said upper end of said at least one bottle segment annular side wall and a cooperating female threaded portion defined by said lower end of said at least one connector ring side wall, and wherein said fourth securement mechanism includes a male threaded portion defined by said lower end of said at least one bottle segment annular side wall and a cooperating female threaded portion defined by said upper end of said at least one connector ring side wall.

5. The baby bottle and milk storage assembly of claim 3 wherein each said at least one connector ring defines a centrally disposed limiting member for limiting the engagement between said at least one connector ring and each said at least one bottle segment.

6. The baby bottle and milk storage assembly of claim 3 further comprising:

a neck member for establishing fluid communication between said at least one bottle segment and a conventional nipple, said neck member defining a lower end and an upper end, wherein said fourth securement mechanism is further provided for releasably securing said at least one connector ring side wall upper end to said neck member lower end; and a fifth securement mechanism for releasably securing said neck member upper end to the conventional nipple.

7. The baby bottle and milk storage assembly of claim 6 wherein said fourth securement mechanism includes a male threaded portion defined by said lower end of said neck member and a cooperating female threaded portion defined by said upper end of said at least one connector ring side wall, and wherein said fifth securement mechanism includes a male threaded portion configured to engage a female threaded portion of a conventional nipple connector ring.

8. The baby bottle and milk storage assembly of claim 1 wherein said at least one end cap annular wall lower end defines an outward taper to assist in nesting and un-nesting two said at least one end cap.

9. A baby bottle and milk storage assembly comprising:

at least one bottle segment defined by an annular side wall, said annular side wall defining a lower end and an upper end and an interior radius, each of said lower end and said upper end defining a male threaded portion;

at least one end cap defining an end wall and an annular wall, said annular wall being disposed about said end wall and defining an upper end extending above said end wall and a lower end extending below said end wall, each of said upper end and said lower end of said annular wall defining a female threaded portion for cooperating with either of said male threaded portion defined by said bottle segment, said at least one end cap defining a sealing ring on an upper side and a lower side of said end wall, said sealing ring being concentric with said end wall and defining a raised portion for engaging an interior radius of said at least one bottle segment, said sealing ring raised portion defining a sloped outer wall having an upper radius smaller than said interior radius of said at least one bottle segment, and a lower radius greater than said interior radius of said at least one bottle segment;

at least one connector ring for connecting one said at least one bottle segment in fluid communication with at least another said at least one bottle segment, said connector ring being defined by an annular wall having an upper end and a lower end, each of said upper end and said lower end defining a female threaded portion for engaging either of at least said bottle segment lower end male threaded portion and said bottle portion upper end male threaded portion; and a neck member for establishing fluid communication between said at least one bottle segment and a conventional nipple, said neck member defining a lower end and an upper end, said lower end defining a first male threaded portion configured to engage said connector ring upper end female threaded portion, said upper end defining a second male threaded portion configured to engage a female threaded portion of a conventional nipple connector ring.

10. The baby bottle and milk storage assembly of claim 9 wherein each said at least one connector ring defines a centrally disposed limiting member for limiting the engagement between said at least one connector ring and each said at least one bottle segment.

11. A baby bottle and milk storage assembly comprising:

at least one bottle segment defined by an annular side wall, said annular side wall defining a lower end and an upper end and an interior radius, each of said lower end and said upper end defining a male threaded portion;

at least one end cap defining an end wall and an annular wall, said annular wall being disposed about said end wall and defining an upper end extending above said end wall and a lower end extending below said end wall, each of said upper end and said lower end of said annular wall defining a female threaded portion for cooperating with either of said male threaded portion defined by said bottle segment, said lower end of said annular wall defining an internal diameter dimensioned to closely receive said annular wall upper end of another said at least one end cap, each said at least one end cap defining a sealing ring on an upper side and a lower side of said end wall, said sealing ring being concentric with said end wall and defining a raised portion for engaging an interior radius of said at least one bottle segment, said sealing ring raised portion defining a sloped outer wall having an upper radius smaller than said interior radius of said at least one bottle segment, and a lower radius greater than said interior radius of said at least one bottle segment;

at least one connector ring for connecting one said at least one bottle segment in fluid communication with at least another said at least one bottle segment, said connector ring being defined by an annular wall having an upper end and a lower end, each of said upper end and said lower end defining a female threaded portion for engaging either of at least said bottle segment lower end male threaded portion and said bottle portion upper end male threaded portion; and a neck member for establishing fluid communication between said at least one bottle segment and a conventional nipple, said neck member defining a lower end and an upper end, said lower end defining a first male threaded portion configured to engage said connector ring upper end female threaded portion, said upper end defining a second male threaded portion configured to engage a female threaded portion of a conventional nipple connector ring.

12. The baby bottle and milk storage assembly of claim 11 wherein said at least one end cap annular wall lower end defines an outward taper to assist in nesting and un-nesting two said at least one end cap.

13. The baby bottle and milk storage assembly of claim 11 wherein each said at least one connector ring defines a centrally disposed limiting member for limiting the engagement between said at least one connector ring and each said at least one bottle segment.

* * * * *